US008408394B2

(12) United States Patent
Mesika

(10) Patent No.: US 8,408,394 B2
(45) **Date of Patent: *Apr. 2, 2013**

(54) SHEET FOR HOLDING ELASTIC LOOPS THEREON

(76) Inventor: Yigal Mesika, Los Angeles, CA (US)

( * ) Notice: Subject to any disclaimer, the term of this patent is extended or adjusted under 35 U.S.C. 154(b) by 140 days.

This patent is subject to a terminal disclaimer.

(21) Appl. No.: 12/970,887

(22) Filed: Dec. 16, 2010

(65) Prior Publication Data

US 2011/0083993 A1 Apr. 14, 2011

Related U.S. Application Data

(63) Continuation-in-part of application No. 11/732,679, filed on Apr. 4, 2007, now Pat. No. 7,861,861.

(51) Int. Cl.
*B65D 73/00* (2006.01)
*B65D 85/02* (2006.01)

(52) U.S. Cl. ..... 206/495; 206/805

(58) Field of Classification Search ..... 206/495, 206/805, 476, 227, 63.3, 395, 303, 348, 388, 206/464, 37, 48, 38, 485, 493
See application file for complete search history.

(56) References Cited

U.S. PATENT DOCUMENTS

| | | | | | |
|---|---|---|---|---|---|
| 231,346 | A | | 8/1880 | Neububgeb | |
| 773,476 | A | * | 10/1904 | Cohn | 242/222 |
| 1,192,594 | A | * | 7/1916 | Woodruff | 242/222 |
| 1,441,266 | A | * | 1/1923 | Clune | 206/410 |
| 2,208,873 | A | * | 7/1940 | Rosenberg | 206/477 |
| 2,328,522 | A | | 8/1943 | Yocum | |
| 2,519,706 | A | * | 8/1950 | Ryan | 206/408 |
| 2,839,185 | A | * | 6/1958 | Isaacs | 206/49 |
| 3,136,418 | A | | 6/1964 | Stacy et al. | |
| 3,462,006 | A | * | 8/1969 | Scott | 206/756 |
| 3,869,044 | A | | 3/1975 | Olsson et al. | |
| D251,059 | S | * | 2/1979 | Montell | D10/64 |
| 4,258,843 | A | * | 3/1981 | Wymer | 206/63.3 |
| 4,615,435 | A | | 10/1986 | Alpern et al. | |
| 4,625,865 | A | * | 12/1986 | Protz, Jr. | 206/388 |
| 5,197,597 | A | | 3/1993 | Leary et al. | |
| 5,277,299 | A | | 1/1994 | Holzwarth et al. | |
| D347,989 | S | * | 6/1994 | DeWard | D8/358 |
| 5,390,782 | A | | 2/1995 | Sinn | |
| 5,435,438 | A | | 7/1995 | Scanlon | |
| 5,584,164 | A | * | 12/1996 | Sinn | 53/430 |

(Continued)

OTHER PUBLICATIONS

U.S. Appl. No. 11/732,679, Non-Final Rejection, Mar. 6, 2009.

(Continued)

*Primary Examiner* — Steven A. Reynolds
(74) *Attorney, Agent, or Firm* — Risso & Associates

(57) ABSTRACT

A container for holding elastic loops therein is described. The container includes a substantially planar card having two portions with a folding section therebetween. A foldable, substantially planar sheet is included for holding elastic loops thereon. The sheet is formed such that it can be contained within the card. A separator is pivotally attached with the card. When an elastic loop is placed upon the sheet and the sheet is positioned upon the card, the separator covers a portion of the sheet such that it holds elastic loops against the sheet. Thus, the separator assists in folding both the elastic loops and sheet when the card is being folded along the folding section. For ease of storage and concealment, the card has a shape and size such that when folded, the card is of a substantially similar shape and size as a credit card for placement within a wallet.

9 Claims, 8 Drawing Sheets

U.S. PATENT DOCUMENTS

| | | | | | |
|---|---|---|---|---|---|
| 5,676,249 | A | * | 10/1997 | DeProspero | 206/388 |
| 5,678,580 | A | * | 10/1997 | Sherman | 132/324 |
| 5,775,504 | A | * | 7/1998 | Menaged | 206/495 |
| 5,819,919 | A | * | 10/1998 | O'Neal | 206/49 |
| 5,909,809 | A | * | 6/1999 | Franklin | 206/525 |
| 6,062,236 | A | * | 5/2000 | Gaudet | 132/321 |

OTHER PUBLICATIONS

U.S. Appl. No. 11/732,679, Final Rejection, Mar. 9, 2010.
U.S. Appl. No. 11/732,679, Non-Final Rejection, Aug. 12, 2010.
Elastic Loop Card, Sold at International Brotherhood of Magicians Convention, 1999.

* cited by examiner

SHEET FOR HOLDING ELASTIC LOOPS THEREON

PRIORITY CLAIM

This is a Continuation-In-Part Application of U.S. patent application Ser. No. 11/732,679, filed on Apr. 4, 2007 now U.S. Pat. No. 7,861,861, and entitled, "A Container for Holding Elastics Loops Therein."

BACKGROUND OF THE INVENTION (1) Field of Invention

The present invention relates to a container, and more particularly to a card-shaped container that is formed to hold a plurality of elastic loops therein.

(2) Description of Related Art

Elastic loops have long been known in the art. By way of example, elastic loops are often considered rubber bands and used to hold items together. For example, rubber bands are typically associated with newspapers, as they hold the newspaper together and prevent it from becoming unraveled.

Expanding upon the rubber band concept, magicians have developed elastic loops that are barely visible and used for magic tricks. Such thin loops allow the magician to perform a variety of tricks while giving the appearance that no loop is present. For example, spreading the thin loop between two hands allows the magician to suspend an object thereon, while providing the illusion that the object is suspended mid air.

When storing such loops, they are typically placed in a box, purse, or other location that results in the loops becoming bunched up and otherwise disorganized. For example and as depicted in FIG. 1, Finn Jon had previously sold elastic loops 101 that were wrapped around a three-panel card 103 that is approximately 250 millimeters (mm) wide. As shown, a few loops 101 (such as 4 or 5) were wrapped around a middle panel 105, with a front panel 107 folding over the front of the loops 101 and a rear panel 109 folding over the back of the loops 101. There are a few distinct disadvantages to the prior art. First, the three panel card 103 is too long (i.e., it is 250 mm wide when opened and 90 mm wide when folded). Second, because of the multiple panels, it is difficult to remove the loops 101 from the three panel card 103 due to the wide front 107 or rear 109 panels. The action of removing the loops 101 from the three panel card 103 of the prior art can cause the loops to break (because they are very thin). Third, the card 103 of the prior art does not have any notches to separate the loops 101, which causes them to become tangled with one another. Fourth, the size of the prior art card 103 is too wide to fit easily within a wallet and, if forcefully put into the wallet, the loops 101 will suffer friction-caused breakage when the wallet is sat on because the loops 101 are not stabilized on the card 103. Fifth, if the prior art card 103 is put forcefully into a wallet, the card 103 will get worn and lose stiffness, which makes it more difficult to remove the loops 101 from the card. Finally, the card 103 is too tall in that it is formed of a dimension so that the loops 101 are stretched tight around the card; however, because the loops 101 are stretched when on the card 103, they become stretched-out over time and lose their elasticity, strength, and effectiveness.

As can be appreciated, due to the illusory nature of their business, it is desirable for magicians to be able to withdraw the barely visible elastic loop without much detection. In the very least, such magicians would need a convenient container to hold the loops in a convenient and organized manner. While the prior art is a simple card that allows loops to be positioned around it, the prior art does not enable for easy concealment within a wallet, nor does it allow for the loops to be safely stored to reduce breakage of the loops.

Thus, a continuing need exists for a small and convenient sheet for safely holding elastic loops thereon. The present invention fulfills such a need.

SUMMARY OF INVENTION

The present invention relates to a container for holding elastic loops therein. The container comprises a substantially planar card having a first portion and a second portion. A folding section exists between the first portion and second portion such that the card is foldable along the folding section. The container also includes a foldable, substantially planar sheet for holding elastic loops thereon. The sheet is formed such that it can be contained within the card.

In another aspect, a separator is pivotally attached with the card proximate the folding section, such that when the sheet is positioned upon the card, the separator is operative to cover a portion of the sheet such that it holds elastic loops against the sheet to assist it in folding when the card is being folded along the folding section.

In yet another aspect, the present invention includes elastic loops for placement over the sheet.

In yet another aspect, the separator is a substantially planar sheet that is affixed with the card such that a separator folding section exists between the card and the separator.

In another aspect, the sheet includes a plurality of notches for holding and separating a plurality of elastic loops.

Furthermore, the card has a shape and size such that when folded, the card is of a substantially similar shape and size as a credit card for placement within a wallet. Thus, a user can conceal the card and elastic loops within the wallet. As such, a user can place an elastic loop around the sheet and place the sheet within the planar card for storage therein.

Finally, as can be appreciated by one in the art, the present invention also comprises a method, for forming and using the container described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
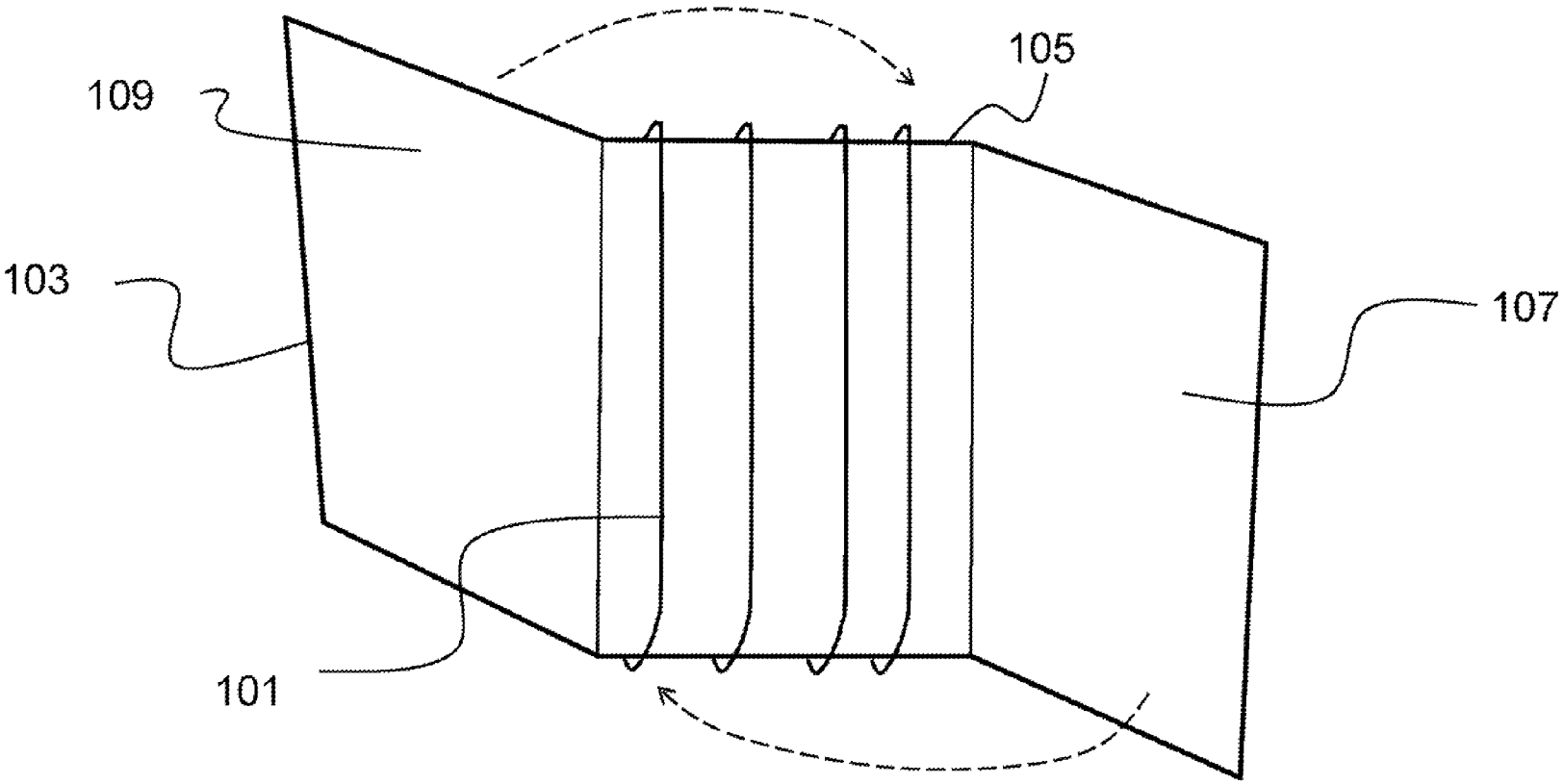
FIG. 1 (Prior Art)
FIG. 1 is an illustration of a card for holding loops according to the prior art.

The present invention relates to a container, and more particularly to a card-shaped container that is formed to hold a plurality of elastic loops therein. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a container and sheet for holding elastic loops. The elastic loop is a secret prop that a magician uses daily. A method that can be used for storing loops is in an envelope of 100 millimeters (mm) by 150 mm. This envelope is not ideal to carry in the magician's pocket because of its size and inability to safely store the loops in the conditions of most pockets. Those envelopes are not made to store in jeans pockets (either the front or back), because the loops are so thin that they will get rubbed and damaged and lose their strength while in the envelope.

There is a need to store this product in a more practical way in the everyday life of the user (magician.) The storage method needs to be very convenient and in a practical location, yet the elastic loops need to stay safe (because they break easily due to being formed of a very thin thread). It is essential to have the product accessible because when a magician uses the elastic loop, he/she often wears it on the wrist for a long period of time, such as for the entire day. Sometimes the elastic loops break when used to perform a particular magic trick. Consequently, it becomes necessary to use more than one elastic loop during a show or period. As such, it is convenient to have the elastic loops stored safely in the wallet and disguised from an audience. An important aspect of the present invention is its ability to keep the loops safe and in a convenient location. Thus, the present invention is directed to sheet for holding elastic loops thereon and a container for positioning the sheet with loops therein.

Figure 2:
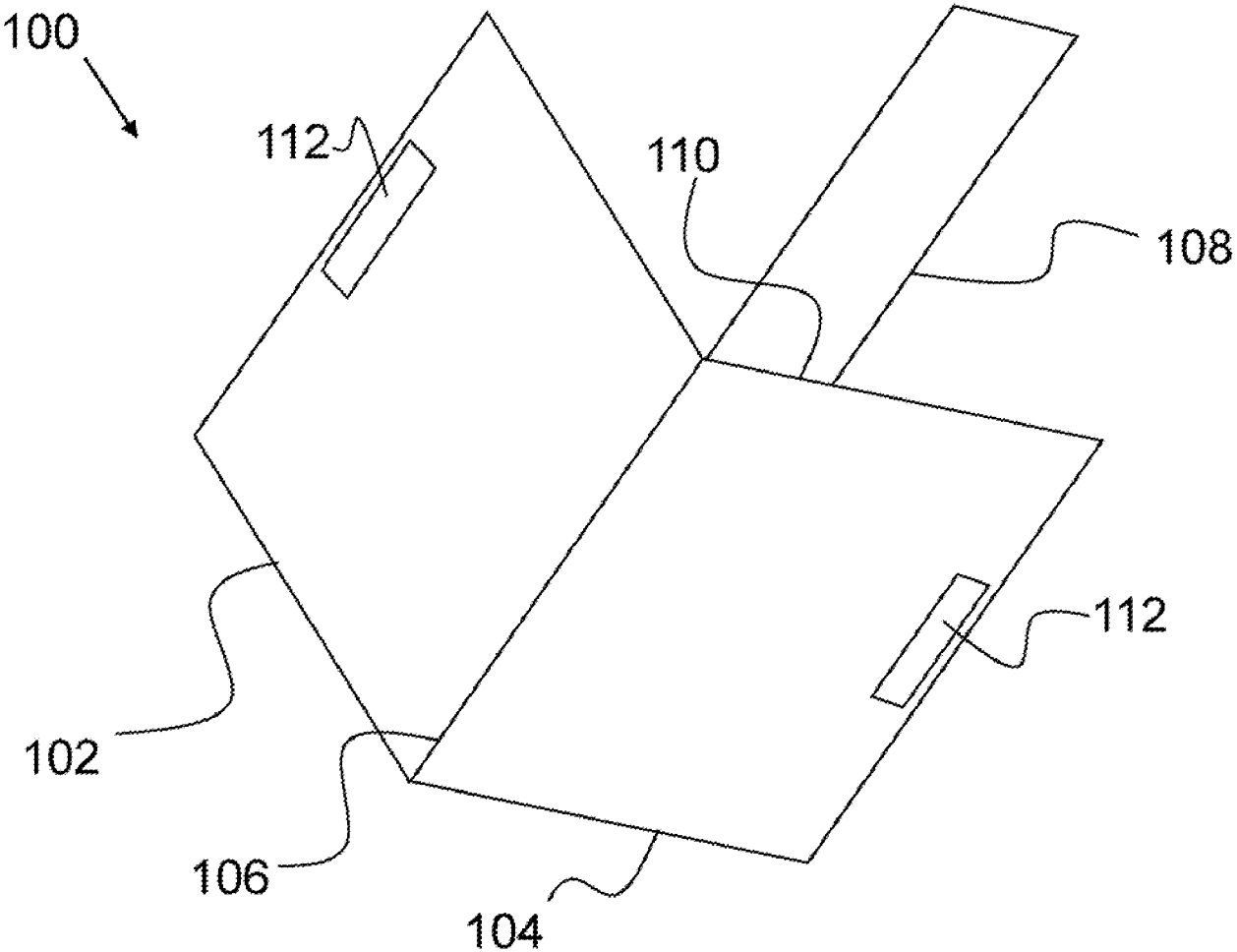
FIG. 2 is an illustration of a card according to the present invention.

As shown in FIG. 2, the container includes a card 100 having a first portion 102 and second portion 104. Each of the first and second portions 102 and 104 are substantially planar and are formed of a suitably rigid and durable material, non-limiting examples of which include plastic, metal, and paperboard. A folding section 106 separates the first and second portions 102 and 104 such that the card 100 is foldable along the folding section 106.

Also included is a separator 108. As can be appreciated by one skilled in the art, the separator 108 can be attached with either the first or second portion 102 and 104, so long as it is proximate the folding section 106. As described in further detail below, the separator 108 is used for holding the elastic loops against the card 100 (and proximate the folding section 106) when the card 100 is being closed. The separator 108 is any suitable mechanism or device for holding elastic loops proximate the folding section 106 and against the card 100. For example, the separator 108 can simply be a paper clip or any other detachably attachable item that can be used to easily affix the elastic loops against the card 100.

In another aspect, the separator 108 is permanently (and pivotally) affixed with the card 100 such that a separator folding section 110 exists between the card 100 and the separator 108. In this aspect, the separator 108 is any suitable protrusion that protrudes away from the card 100 and that can be folded back over the card 100 to hold elastic loops against the card. As a non-limiting example, the separator 108 is a substantially planar sheet. In this aspect, the separator 108 and the first and second portions 102 and 104 can be formed of the same planar sheet of material, with the corresponding folding sections therebetween.

Figure 8:
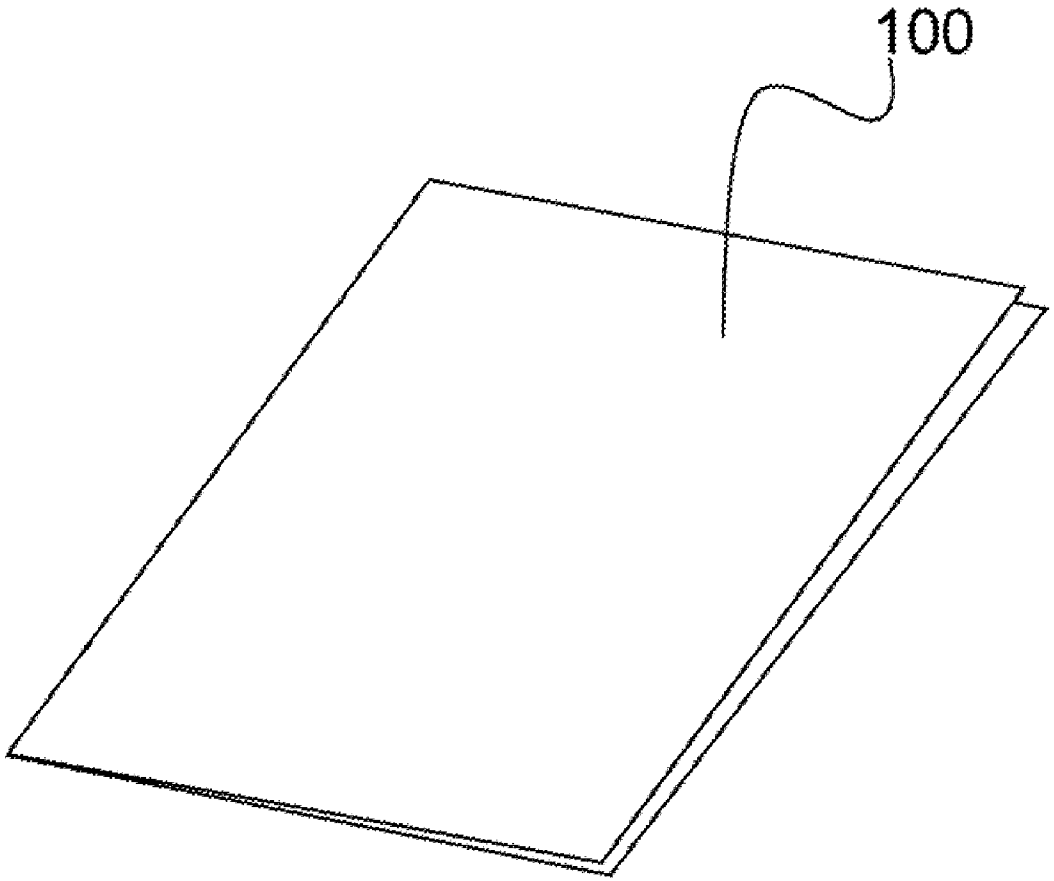
FIG. 8 is an illustration of the card as closed with the elastic loops held therein.

To maintain the first portion 102 and second portion 104 in a closed position (as illustrated in FIG. 8), a connector 112 is attached with either one of or both of the first and second portions 102 and 104. The connector 112 is any suitable mechanism or device for detachably attaching two objects together, non-limiting examples of which include hook and loop fasteners, magnets, and snaps. In another aspect, the connector 112 is a magnet on one of the portions, while a corresponding piece of metal is positioned on the other portion. In any configuration, the connector 112 effectively operates to hold the card 100 in a closed position so that any elastic loops therein remain affixed within the card 100.

Figure 3:
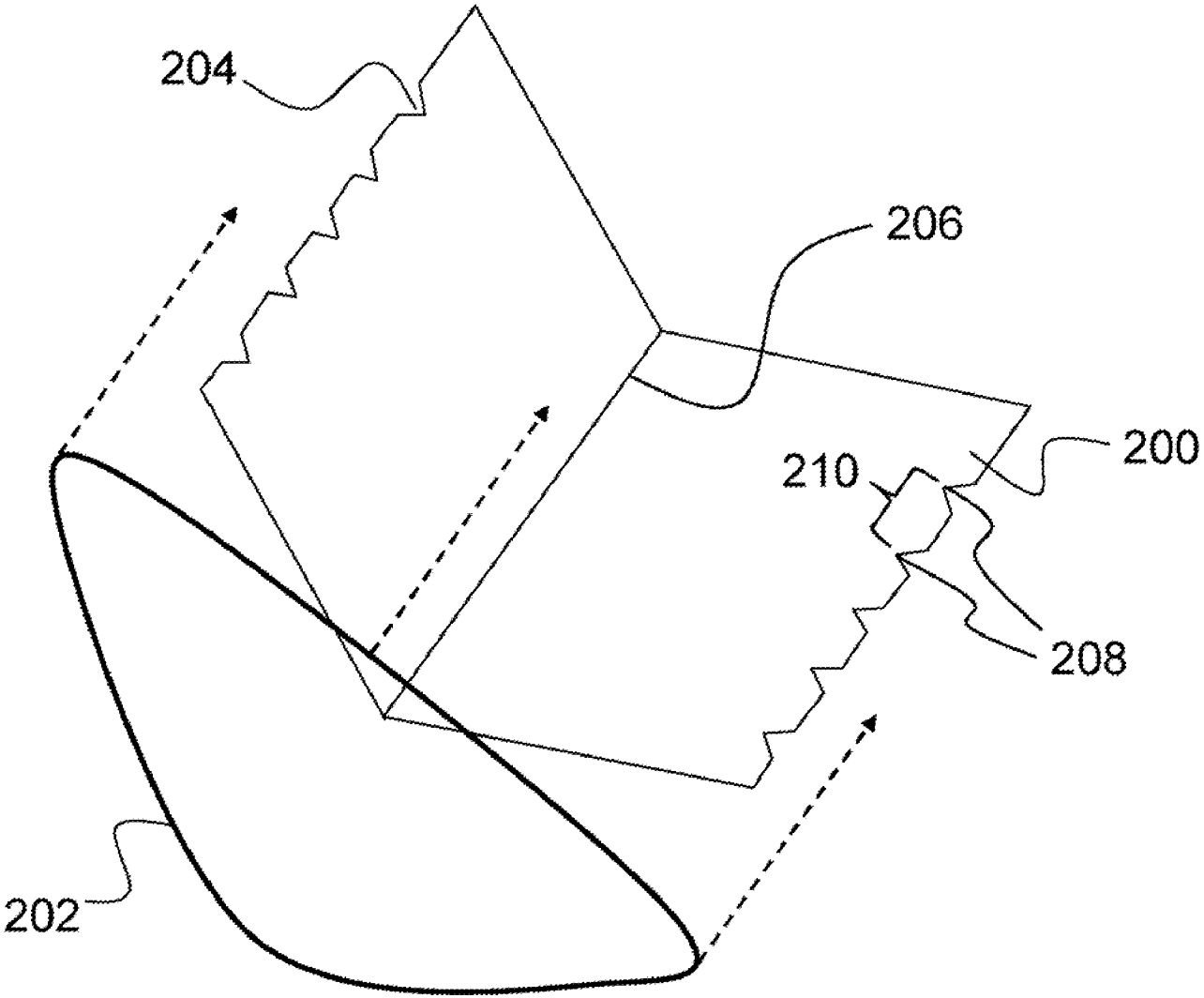
FIG. 3 is an illustration of a sheet for placement of an elastic loop thereon, according to the present invention.

As noted above, the present invention also is directed to a sheet for holding elastic loops thereon. The sheet can be used with the container described above, or used alone. FIG. 3 illustrates the sheet 200. The sheet 200 is any suitable mechanism or device for holding elastic loops 202 thereon. As a non-limiting example, the sheet 200 is a foldable, substantially planar sheet. The sheet 200 is formed such that it can be contained within the card. In other words, a user can place the elastic loops 202 around the sheet 200 and place the sheet 200 within the planar card for storage therein. The sheet 200 is formed of any suitably planar material, non-limiting examples of which include paper and paperboard.

When placing multiple loops 202 around the sheet 200, it may be beneficial to include a separator for holding the loops 202 separate from one another. The separator is any suitable mechanism for holding an elastic loop 202 (or loops) affixed in place with respect to the sheet 200. As a non-limiting example, the separator includes a plurality of notches 204. In this aspect, the sheet 200 has a plurality of notches 204 to allow a user to place multiple loops 202 around the sheet 200, with each loop 202 being wrapped around its respective notch 204.

It should also be noted that the sheet 200 has a fold line or crease 206. In order to use the sheet 200 to grab a loop 202, the sheet 200 needs to be bent. Thus, the specially made crease 206 makes the item intuitive and easy to use. The crease 206 in the card holder (i.e., sheet 200) is essential in order to keep it in the wallet (safely and conveniently) and accessible at a moment's notice. The sheet 200 can be formed of any suitable size or dimension. For example, the size and/or dimension of the sheet is 73 mm wide by 106 mm long.

Further, each of the plurality of notches 204 can be formed in any suitable shape or size. Although not limited thereto, each cone-shaped or round-shaped notch 204 is 6.5 mm wide and 4.5 mm deep. This dimension is provided to prevent the magician from accidentally knocking other loops 202 off of the sheet 200 when retrieving a particular loop 202. As noted above, the sheet 200 includes a crease 206 in the middle so that it can fold in half. The sheet 200 is made in a way so that the loop 202 will not be easily snagged out of place. The loops 202, when positioned in the notches 204, are spaced evenly at exactly 12 mm all the way across from side of the sheet 200. Thus, the tips 208 of the notches 204 are spaced 210 approximately 12 mm apart. This spacing prevents the loops 202 from getting tangled with one another.

When the sheet 200 is folded at the specially made crease 206 (which is made to fold easily in half), so that when folded, the sheet 200 is approximately the width of a credit card/I.D. The reason for this width dimension is so that the sheet 200 can be stored in a wallet securely and practically. For example, using the crease 206, the sheet 200 with loops 202 can be positioned perfectly, safely, and conveniently inside a container 100, as illustrated in FIGS. 4 through 8. To put the loops in a special loops plastic card using the special crease made to have the card loader fit perfectly, safely, and conveniently inside.

Figure 6:
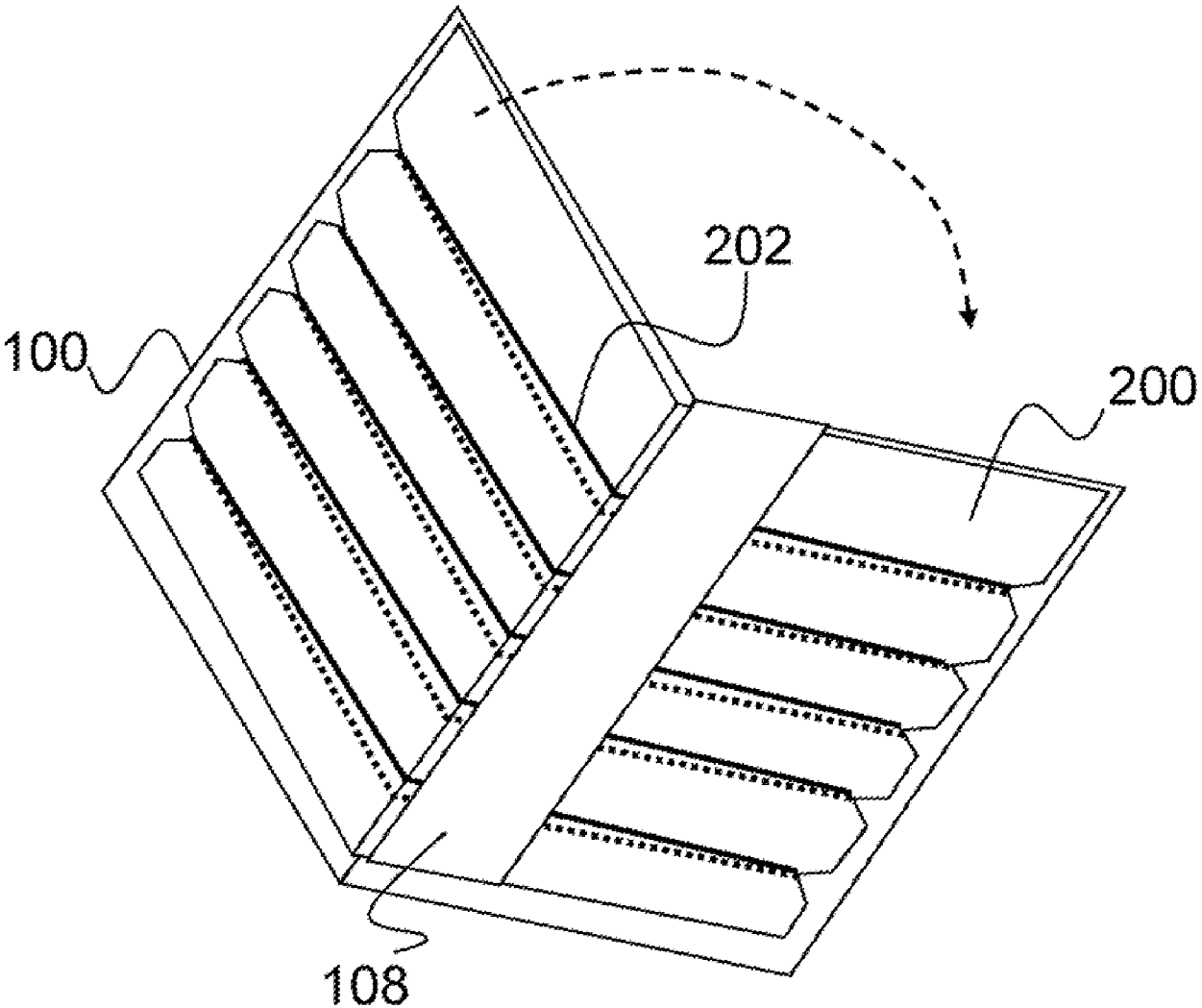
FIG. 6 is an illustration of the card being closed with the elastic loops and sheet therein.

As another example, the sheet 200 can be folded around a credit card, with the credit and sheet 200 then being positioned into one of the magician's credit card pockets (in their wallet) so that it is safe. In this aspect, the credit card itself acts as a separator (instead of the separator 108 as shown in FIG. 6) to keep the loops 202 safe. If the crease 206 was not present and the sheet 200 with loops 202 went into the wallet, it would have to go where the bills go; however, the problem with that is the bill will snag onto the elastic thread and snap them. Again, the crease 206 facilitates the ease of use of the present invention and the ability to safely and securely store the elastic loops 202.

Figure 4:
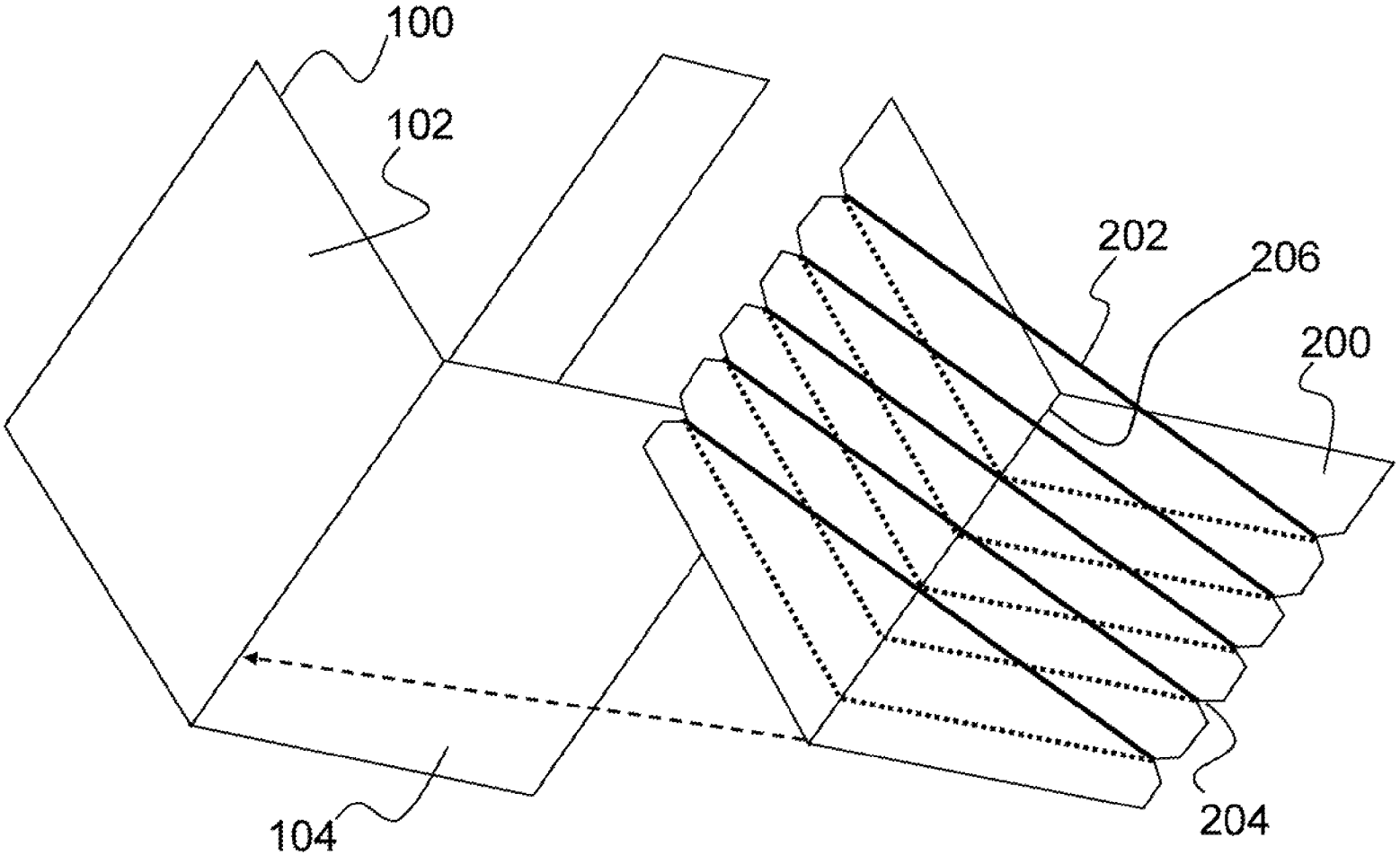
FIG. 4 is an illustration of the sheet being positioned within the card.

FIG. 4 illustrates the sheet 200 with a plurality of loops 202 wrapped around the sheet 200. As shown, each loop 202 is affixed with its corresponding notch 204. As can be appreciated by one skilled in the art, the notch 204 (or separator) is not necessary for operation of the present invention, but merely further facilitates the separation of multiple loops 202.

As can be appreciated by one skilled in the art, the sheet 200 is formed in any suitable shape and/or size such that it can be contained within the first and second portions 102 and 104 for easy placement within the card 100. In another aspect (not illustrated), the sheet 200 is pivotally connected with the card 100 along one of its edges such that it can fold in-and-out from an interior of the card 100.

Figure 5:
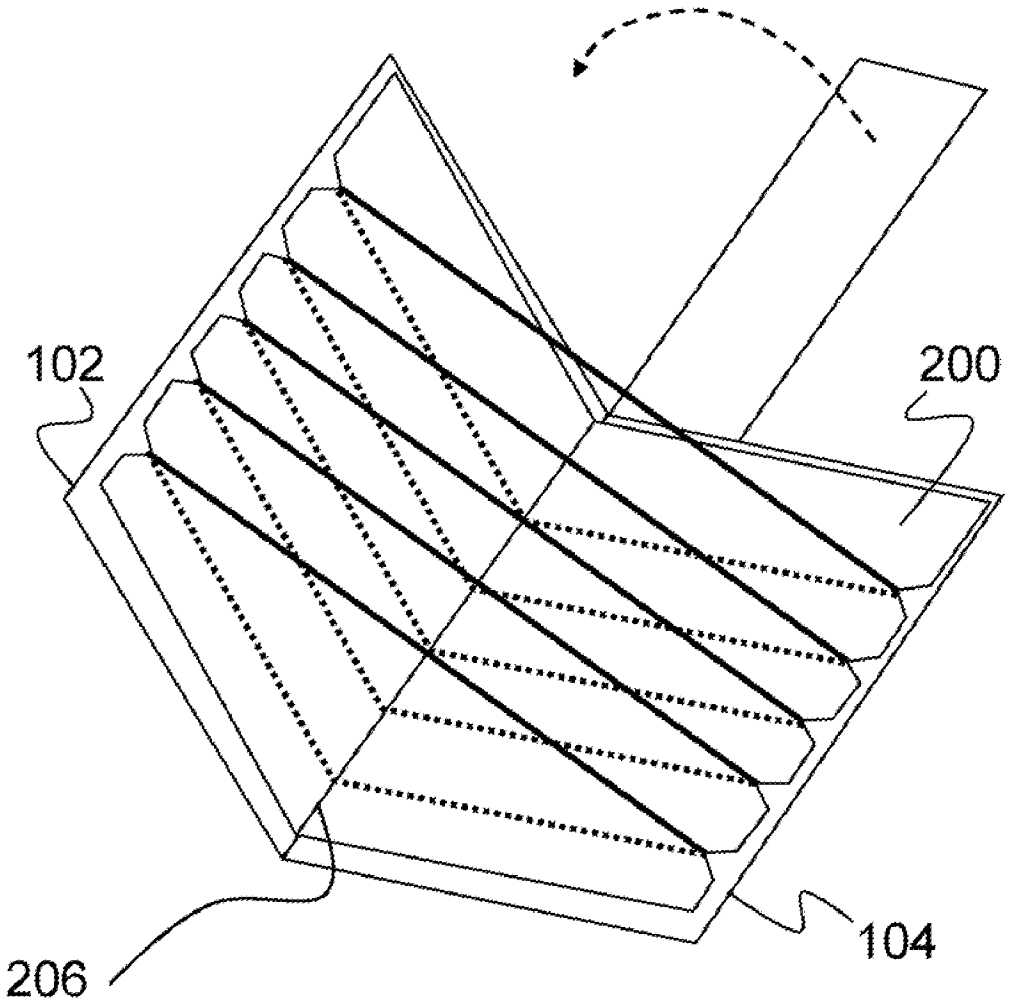
FIG. 5 is an illustration of a separator that is attached with the card being folded over the elastic loops positioned upon the sheet.

FIG. 5 illustrates the sheet 200 as placed between the first and second portions 102 and 104. As illustrated in FIG. 6, once the sheet 200 is placed against the card 100, the separator 108 can be used to hold the elastic loops 202 against the card 100.

Figure 7:
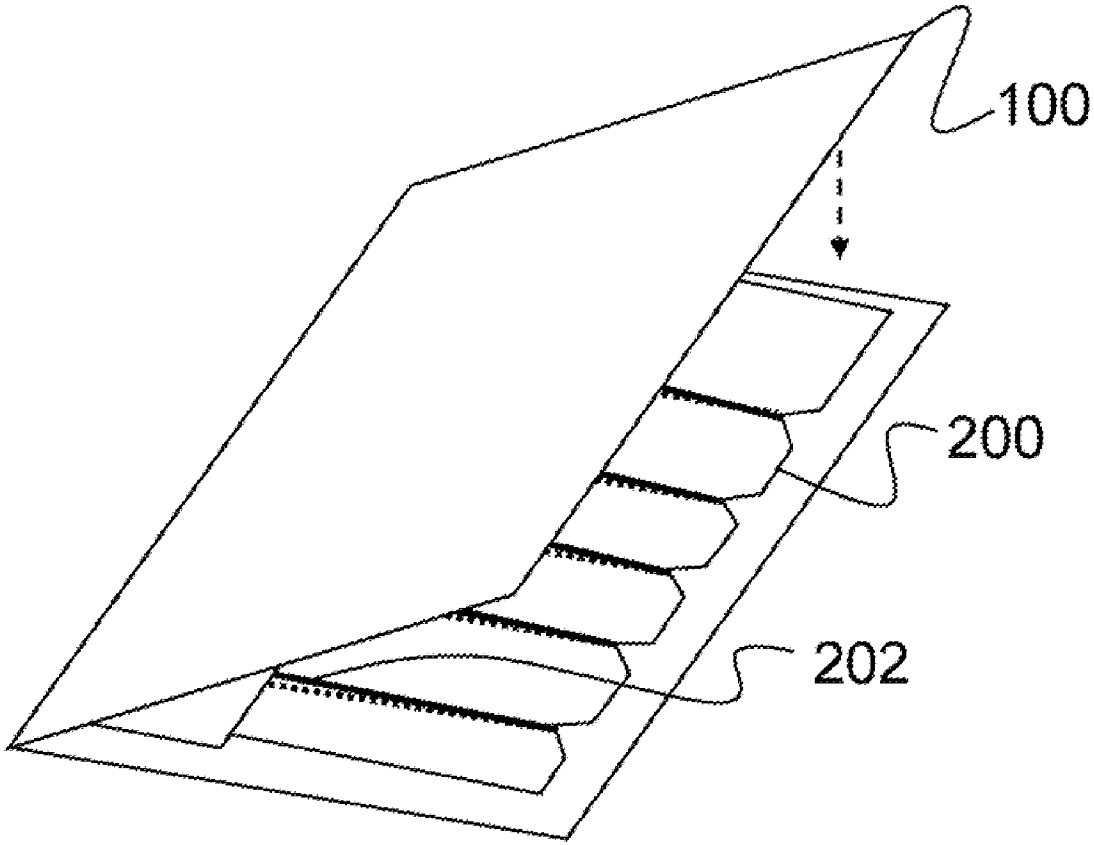
FIG. 7 is an illustration of the card being further closed for encasing the elastic loops therein.

FIG. 7 illustrates the card 100 being closed, with the sheet 200 and elastic loops 202 therein. As illustrated, the card 100 is closed by closing the first and second portions 102 and 104 against one another.

Finally, FIG. 8 illustrates the card 100 in a closed position. In one aspect, the card 100 with the sheet and elastic loops therein, is approximately the size of a credit card when closed. In this aspect, a magician or other user can easily carry the present invention within the user's wallet, thereby allowing the user to conceal the elastic loops therein. Such a benefit provides magicians and others with the ability to easily carry elastic loops while providing the illusion that no such container is being carried.

What is claimed is:

1. A sheet for holding elastic loops, comprising:

a foldable, substantially planar sheet for holding elastic loops thereon, the sheet being formed such that it has two opposing sides having a fold line therebetween and can be folded along the fold line and contained within an item for storage; and wherein each of the opposing sides has an external perimeter edge, with a plurality of notches formed along the external perimeter edge for holding and separating a plurality of elastic loops, wherein the fold line bisects the two opposing sides and runs between each of the external perimeter edges and the plurality of notches formed on each external perimeter edge such that it is approximately parallel to the external perimeter edges having the plurality of notches, whereby a user can place an elastic loop around the sheet, fold the sheet along the fold line, and place the sheet within the item for storage therein.

2. A sheet as set forth in claim 1, further comprising elastic loops for placement over the sheet;

wherein the plurality of notches comprise five notches on each opposing side; and wherein five elastic loops are positioned across the notches.

3. A sheet as set forth in claim 2, wherein the two opposing sides are each a mirror of the other, such that the planar sheet is formed of two halves, with each half being one of the two opposing sides and separated by the fold line.

4. A sheet as set forth in claim 3, wherein the sheet is approximately 73 millimeters wide by 106 millimeters long.

5. A sheet as set forth in claim 4, wherein each of the plurality of notches is approximately 6.5 millimeters wide and 4.5 millimeters deep.

6. A sheet as set forth in claim 1, wherein the two opposing sides are each a mirror of the other, such that the planar sheet is formed of two halves, with each half being one of the two opposing sides and separated by the fold line.

7. A sheet as set forth in claim 1, wherein the sheet is approximately 73 millimeters wide by 106 millimeters long.

8. A sheet as set forth in claim 1, wherein each of the plurality of notches is approximately 6.5 millimeters wide and 4.5 millimeters deep.

9. A sheet as set forth in claim 1, wherein the planar sheet has a shape and size such that when folded along the fold line with the two opposing sides positioned against one another, the sheet is of an approximately similar shape and size as a credit card for placement within a wallet, thereby allowing a user to conceal the sheet and elastic loops within the wallet.

* * * * *